US005095728A

United States Patent [19]

Poloni

[11] Patent Number: 5,095,728

[45] Date of Patent: Mar. 17, 1992

[54] DEVICE TO CHANGE THE EQUIPMENT ON AN INTEGRATED PLURALITY OF ROLLING STANDS WITH PAIRS OF ROLLS SUPPORTED AS CANTILEVERS WITH ALTERNATE AXES

[75] Inventor: Alfredo Poloni, Fogliano di Redipuglia, Italy

[73] Assignee: Danieli & C. Officine Meccaniche SpA, Buttrio, Italy

[21] Appl. No.: 683,121

[22] Filed: Apr. 9, 1991

Related U.S. Application Data

[63] Continuation of Ser. No. 422,429, Oct. 17, 1989, abandoned.

[30] Foreign Application Priority Data

Oct. 18, 1988 [IT] Italy ..... 83497 A/88

[51] Int. Cl.[5] ..... B21B 31/08

[52] U.S. Cl. ..... 72/239

[58] Field of Search ..... 72/235, 238, 239

[56] References Cited

U.S. PATENT DOCUMENTS

| | | | |
|---|---|---|---|
| 3,425,256 | 2/1969 | McGoogan et al. | 72/239 |
| 3,498,099 | 3/1970 | Thompson | 72/238 |
| 4,005,594 | 2/1977 | Reth et al. | 72/239 |
| 4,366,694 | 1/1983 | Pariseau et al. | 72/238 |

FOREIGN PATENT DOCUMENTS

| | | |
|---|---|---|
| 1941186 | 11/1968 | Fed. Rep. of Germany . |
| 1545751 | 9/1967 | France . |
| 0118939 | 9/1984 | United Kingdom . |
| 0142879 | 5/1985 | United Kingdom . |
| 0163104 | 8/1987 | United Kingdom . |

*Primary Examiner*—Lowell A. Larson
*Assistant Examiner*—Thomas C. Schoeffler
*Attorney, Agent, or Firm*—Antonelli, Terry Stout & Kraus

[57] ABSTRACT

Device to change the equipment on a compact rolling block (11) consisting of an integrated plurality of rolling stands with pairs of rolls supported as cantilevers with alternate roll axes, a complete change of the equipment taking place substantially at one and the same time on all the stands, the equipment being delivered in a coordinated manner already positioned, pre-set and complete with rolls, roller boxes, supports, splitters, pinch rolls and all other necessary items, the device comprising a movable device (10) which operates in front of the compact rolling block (11) and bears horizontal (20) and vertical (19) assemblies of equipment holders (18), the equipment holders (18) of one assembly (20-19) alternated with those (18) of the other assembly (19-20), each equipment holder (18) comprising at least a first working side (22) and a second working side (23) and being capable of being rotated by at least 180° about a rotation shaft (21).

1 Claim, 3 Drawing Sheets

DEVICE TO CHANGE THE EQUIPMENT ON AN INTEGRATED PLURALITY OF ROLLING STANDS WITH PAIRS OF ROLLS SUPPORTED AS CANTILEVERS WITH ALTERNATE AXES

This application is a continuing application of prior application Ser. No. 07/422,429, filed Oct. 17, 1989, now abandoned.

This invention concerns a device for the simultaneous exchange of the equipment on a plurality of integrated rolling stands having pairs of rolls supported as cantilevers on alternate horizontal and vertical axes.

To be more exact, the invention concerns a device to replace simultaneously all the equipment on a coordinated plurality of integrated stands having their pairs of rolls supported as cantilevers with axes at alternate angles, such as those of EP-A-84200176.0 for instance.

By the word "equipment" are meant the rolls, the guides for the rolled stock, the roller boxes and everything else to be fitted to the naked machine so as to obtain a complete assemblage able to perform correct rolling of sections or other rolled stock required.

EP-A-84201499.5 discloses a device to replace the rolls and/or equipment on rolling stands having their rolls supported as cantilevers, the device comprising frame means with attachment means, jaw means with engagement means and actuation means; the reciprocal positioning of the parts when engaged by the device is substantially the same as the reciprocal positioning of the same parts when fitted to the rolling unit.

U.S. Pat. No. 3,425,256 discloses a device to replace the rolls of a straightening machine having multiple rolls with horizontal or vertical axes. This device exchanges one pair of rolls at a time and serves to replace only the rolls.

FR 1.545.751 discloses a device to replace only the rolls, and only one of them at a time, on a plurality of rolling stands which have their rolls inclined in one direction or the other alternately.

This teaching of the state of the art covers the replacement of one or two rolls or both rolls complete also with all the equipment.

Teaching which envisages the ability to replace all the equipment on a rolling stand with rolls supported as cantilevers is not applicable, except as a general subject, to a coordinated plurality of compact stands with rolls supported as cantilevers of the type, for instance, disclosed in EP-A-84200176.0 cited regarding the field of application above.

A plurality of problems arises in the case of compact rolling blocks consisting of a coordinated plurality of stands with rolls supported as cantilevers, the pairs of rolls being positioned alternately with their roll axes at an angle to each other.

Some of these problems can be listed as follows: correct simultaneous alignment; alternate positioning of the roll axes, for instance vertical, horizontal, vertical, etc.; gradual, progressive differentiation of the equipment in the feed of the product in view of the differentiated effect to be imparted by the equipment to the product during processing; perfect, coordinated positioning and alignment of the items of equipment in relation to each other in the required working sequence.

The device to change the equipment on an integrated plurality of stands having pairs of rolls supported as cantilevers and positioned on alternate axes is disclosed.

According to the invention a movable device able to carry out positioning as required in cooperation with the compact rolling block is located in front of that block and bears a movable equipment holder means which performs reciprocal positioning of the equipment and is able to rotate about its own axis.

Alternate movable equipment holder means to perform reciprocal positioning are included in direct correlation with the alternation of the axes of the pairs of rolls so as to form two assemblies of which the components are spaced apart.

Each assembly has its own common shaft for rotation of the single movable equipment holder means that performs reciprocal positioning.

Each movable equipment holder means to provide reciprocal positioning can be actuated either independently or in coordination with the other movable equipment holder means of the same assembly or with all the other movable equipment holder means.

Each single movable equipment holder means includes at least two working sides having differentiated purposes even if these purposes can be allotted equally well to one working side or the other. These purposes are the engagement of the old equipment together with the pair of rolls in use and the delivery of the new equipment with the pair of rolls to be put to work.

This enables the new equipment complete with every detail and component to the arranged on one side while the other side is arranged for removal of the existing equipment with one single action.

It also makes it possible to pre-arrange beforehand in the workshops or in the preparation site everything required for the fitting, including clamps, catches and the necessary adjustments, so that only the mechanical action of taking the old equipment and fitting the new equipment is required on the worksite.

The attached figures, which are given as a non-restrictive example, show the following:

Figures 1, 2, 3:
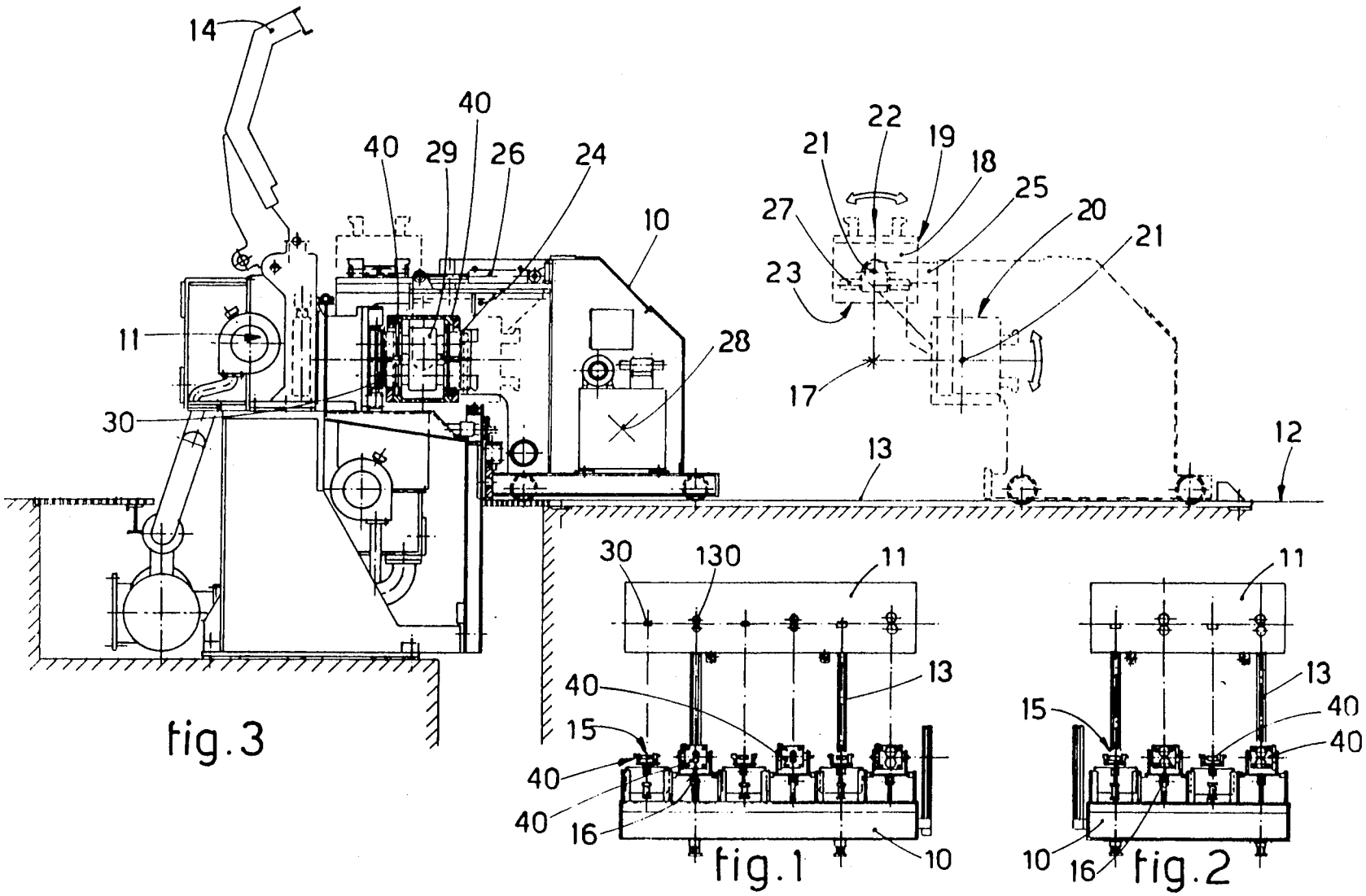
FIG. 1 shows from above the invention as applied to a rolling block having six pairs of rolls.
FIG. 2 shows from above the invention as applied to a rolling block having four pairs of rolls.

FIG. 3 gives a side view of an embodiment according to the invention.

Figure 4:
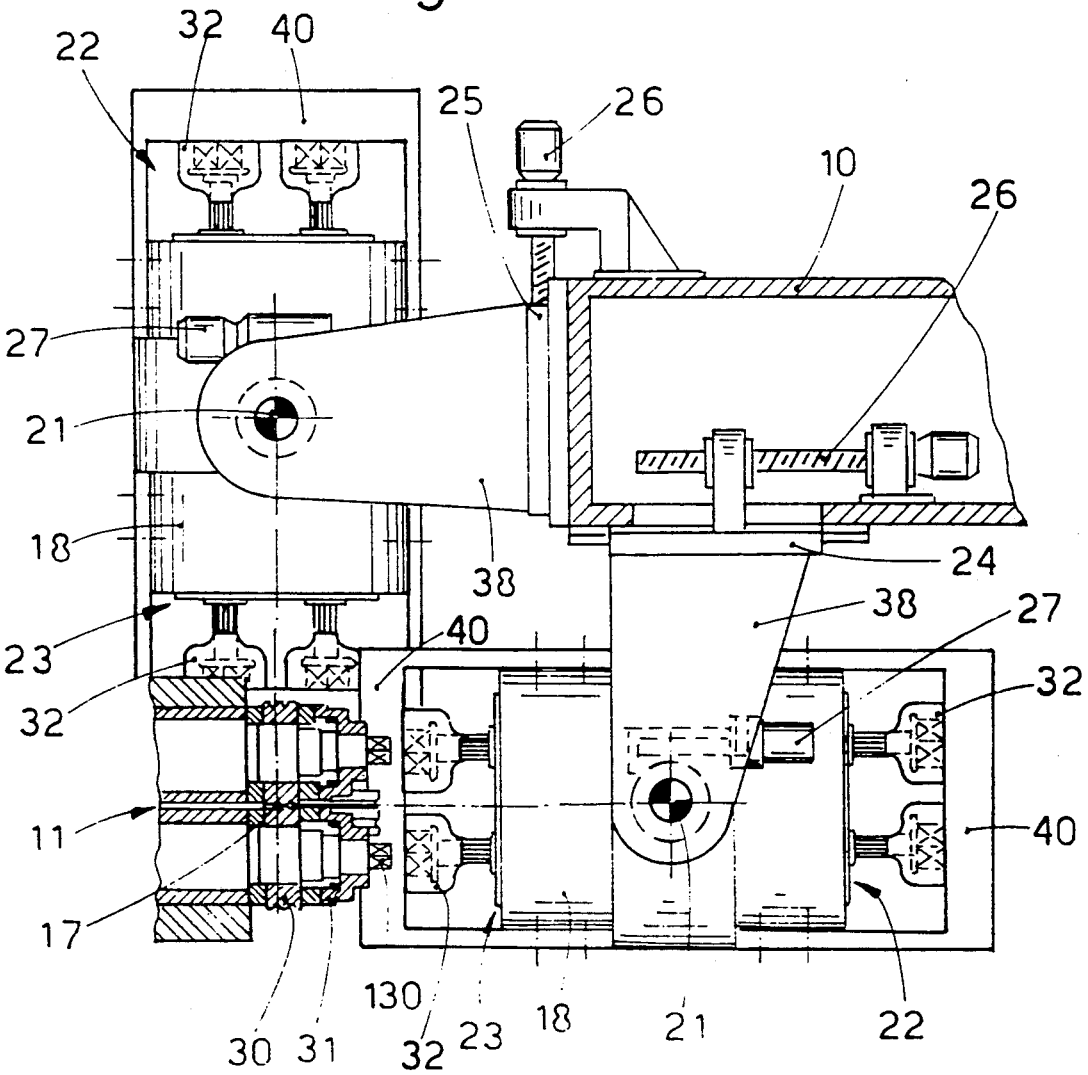
Figure 5:
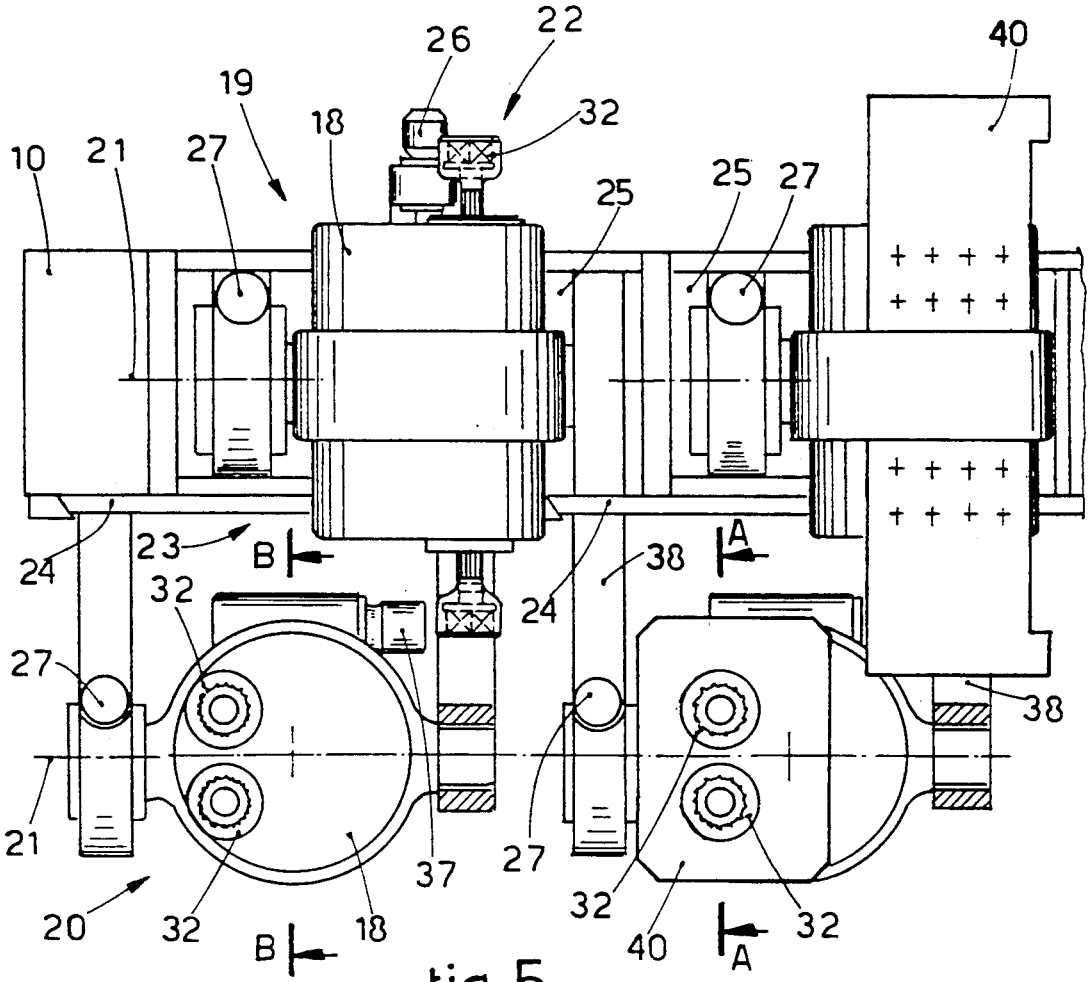
Figure 6:
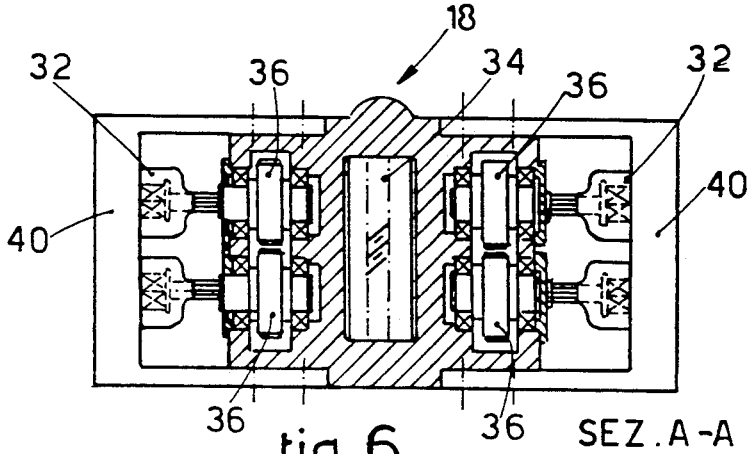

FIG. 4 is an enlarged side view of the equipment holder assemblies of the present invention;

FIG. 5 is a enlarged front view of the equipment holder assemblies of the present invention (in FIG. 5, the left-hand plates 40 are not shown so that the units 18 may be clearly seen);

FIG. 6 shows a pair of rolls along section A—A of FIG. 5; and

Figure 7:
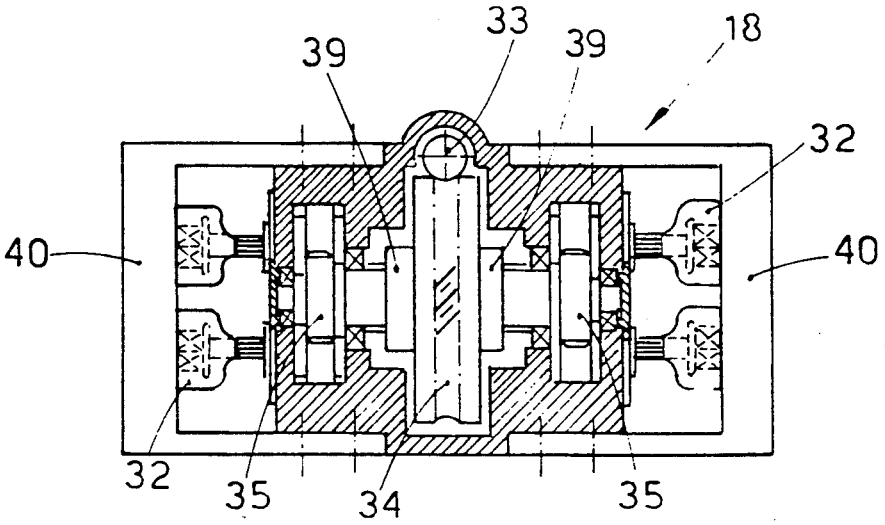

FIG. 7 shows a pair of rolls along section B—B of FIG. 5.

In the figures a compact rolling block 11 consisting of a plurality of stands with pairs of rolls 29 supported as cantilevers with alternate roll axes of the type of EP-A-84200176.0, for instance, may have four (FIG. 2), six (FIG. 1) or more pairs of rolls supported as cantilevers 29 with a rolling axis 17.

These pairs of rolls supported as cantilevers 29 are included in the compact rolling block 11 in alternate positions so that one pair of rolls having a vertical axis 16, for instance, is followed by a pair of rolls having a horizontal axis 15 and viceversa.

During work the pairs of rolls 29 are shielded by a suitable protective cover 14.

In the example shown, runways 13 cooperating with the floor 12 are included in front of the compact rolling block 11; in a variant other guide means such as a magnetic guide wire or another means may be comprised.

A movable positioner device 10 cooperates with the runways 13 and in this case, at least in the last process step, may move in front of the compact rolling block 11 and occupy a substantially parallel reciprocal position between the front of the movable device 10 and the front of the compact rolling block 11.

In this caes the movable device 10 is independent and comprises at least one power unit operated, for instance, by oil under pressure.

Means 40 suitable to support, position and guide equipment holders 18 are spread in front of the movable device 10 and towards the compact rolling block 11. The means may take the form of plates 40 as shown in FIGS. 1-7 and described in more detail in U.S. Pat. No. 4,726,108.

The equipment holders 18 are arranged in assemblies, a horizontal assembly 20 and a vertical assembly 19; the equipment holders 18 of one assembly are separated from those of the other assembly.

As shown generally in FIG. 3 and more specifically, in FIGS. 4 and 5, the individual equipment holders 18 are supported and positioned by a pair of movable supports per each equipment holder 18, namely movable horizontal supports 24 for the equipment holders 18 of the horizontal assembly 20 and movable vertical supports 25 for the equipment holders 18 of the vertical assembly 19 respectively.

The movable supports 24-25 are able to move respectively in a horizontal direction (horizontal movable supports 24) and a vertical direction (vertical movable supports 25).

Displacement of the movable supports 24-25 can be obtained and controlled by rams 26 or other suitable means.

The equipment holders 18 are fitted to the movable supports 24-25 and can be rotated by actuators 27 about a shaft 21.

The rotation of the equipment holders 18 and the control of their angular position can be achieved with a rack and pinion, the pinion being coaxial with and integrally fixed to the rotation shaft 21, while the rack can be moved lengthwise by a jack, for instance.

The working positions of the single equipment holders 18 are arranged respectively with a vertical axis (vertical assembly 19) and a horizontal axis (horizontal assembly 20), and in the example shown in equipment holders 18 can rotate by 180° so as to offer firstly a first working side 22 and thereafter a second working side 23.

However, the equipment holders 18 can rotate by any desired angle, even by 360° or more.

One of the first 22 and second 23 working sides serves to prepare all the new pre-arranged and organized equipment, while the other side serves to take away the equipment already at work.

More specifically, as shown in FIGS. 4-7, the working sides 22 and 23 comprise means 32 which are anchored to the two nuts 31 clamping the rolls 30-130 to their respective shafts of the rolling block 11 and which act on the nuts 31. The nuts 31 are screwed tight or unscrewed depending on the rotation of the means 32. As shown in FIGS. 6 and 7, rotation of the means 32 takes place owing to the gearwheels 36, which are set in rotation by the gearwheel 35; to gearwheel 35 is coaxial with the epicyclic reduction gear 34, and a brake/clutch 39 is included between the gearwheel 35 and the epicyclic reduction gear 34 and on the two sides of the reduction gear 34, and enables the means 32 of the side 22 or the means 32 of the side 23 or both means 32 to be acutated. A epicycle reduction gear 34 in this case has a circumferential toothing which cooperates with a worm 33 actuated by the motor 37.

In the case shown the rolls 30-130 working with a gauge or groove 17 which coincides with the rolling axis 17. The rolling axis 17 (FIG. 4) coincides with the plane that contains the axes of rotation of the horizontal equipment holder assemblies 18 and with the plane that contains the axes of rotation of the vertical equipment holder assemblies 18.

The equipment holder assemblies 18 comprise a lateral pin, the axis of which is the axis of rotation of the equipment holder assemblies 18; the pin is anchored to the uprights 38 of the movable supports 24 or 25 and can rotate freely on one side and is actuated circumferentially on the other side. This circumferential actuate, which serves for correct positioning, is caused by the actuator 27, which in this case consists of a worn-/toothed wheel reduction unit, the worm being driven by a motor.

In this way the movable device 10 is able to approach and position itself in relation to the compact rolling block 11, to position the second working side 23 on the existing equipment, to take the existing equipement, to remove the equipment holders 18 from the compact rolling block 11 and rotate them by 180° in this case, to position the first working side 22 on which all the new equipment is arranged and to deliver to the compact rolling block 11 all the equipment already arrnaged, positioned and pre-set.

Alignment and guide means will be included advantageously in front of the compact rolling block 11 and will cooperate with analogous means comprised in the movable device 10 to ensure proper alignment.

Reciprocal coupling means may also be included between the compact rolling block 11 and movable device 10 so as to provide reciprocal anchorage during the functioning of the equipment holders 18.

I claim:

1. A device to change equipment on a compact rolling block including an integrated plurality of rolling stands with pairs of rolls supported as cantilevers with alternate roll axes, comprising:

a frame;

horizontal and vertical assemblies of equipment holders supported alternately on said frame by respective horizontally and vertically movable supports;

wherein each equipment holder comprises at least a first working side and a second working side and wherein each equipment holder is mounted on its respective movable support for rotation by at least 180° about a rotation shaft for alternately positioning each of said first and second working sides to face said compact rolling block, said first working sides supporting prepositioned, pre-set equipment including rolls, roller boxes, supports, splitters and pinch rolls, and said second working sides comprising means for removing equipment from said compact rolling stand;

means for rotating said equipment holders about said rotation shaft; and means for moving said frame towards and away from said compact rolling stand.

* * * * *